United States Patent [19]

Grant et al.

[11] Patent Number: 4,647,492

[45] Date of Patent: Mar. 3, 1987

[54] TEXTILE INTERLINING MATERIAL HAVING ANISOTROPIC PROPERTIES

[75] Inventors: Eric M. Grant, Elland; Edward Walker, Halifax, both of United Kingdom

[73] Assignee: Firma Carl Freudenberg, Weinheim, Fed. Rep. of Germany

[21] Appl. No.: 620,899

[22] Filed: Jun. 15, 1984

[30] Foreign Application Priority Data

Jun. 20, 1983 [GB] United Kingdom ..... 8316704

[51] Int. Cl.[4] ..... B32B 27/14

[52] U.S. Cl. ..... 428/198; 2/97; 428/195; 428/284; 428/287; 428/293; 428/294; 428/296; 428/297; 428/298; 428/340; 428/398

[58] Field of Search ..... 428/105, 109, 114, 292, 428/293, 294, 295, 296, 297, 298, 300, 198, 283, 284, 402, 232, 340, 287, 398; 2/97

[56] References Cited

U.S. PATENT DOCUMENTS

| | | | |
|---|---|---|---|
| 3,449,187 | 6/1969 | Bobkowicz | 428/293 |
| 4,333,980 | 6/1982 | Russell | 428/198 |
| 4,373,000 | 2/1983 | Knoke et al. | 428/198 |
| 4,438,533 | 3/1984 | Hefele | 428/198 |
| 4,490,427 | 12/1984 | Grant et al. | 428/294 |
| 4,504,539 | 3/1985 | Petracek et al. | 428/294 |
| 4,511,615 | 4/1985 | Ohta | 428/195 |
| 4,514,455 | 4/1985 | Hwang | 428/195 |

*Primary Examiner*—James J. Bell

*Attorney, Agent, or Firm*—Felfe & Lynch

[57] ABSTRACT

An interlining material having reinforcing filaments aligned parallel to one another and having an anisotropic stiffening action. They are characterized by a melting point of more than 180° C. and are applied to a substrate surface melting at temperatures below 150° C. Also described is a method of production whose steps are coordinated with the melting behavior of the substrate surface and reinforcing filaments.

32 Claims, 4 Drawing Figures

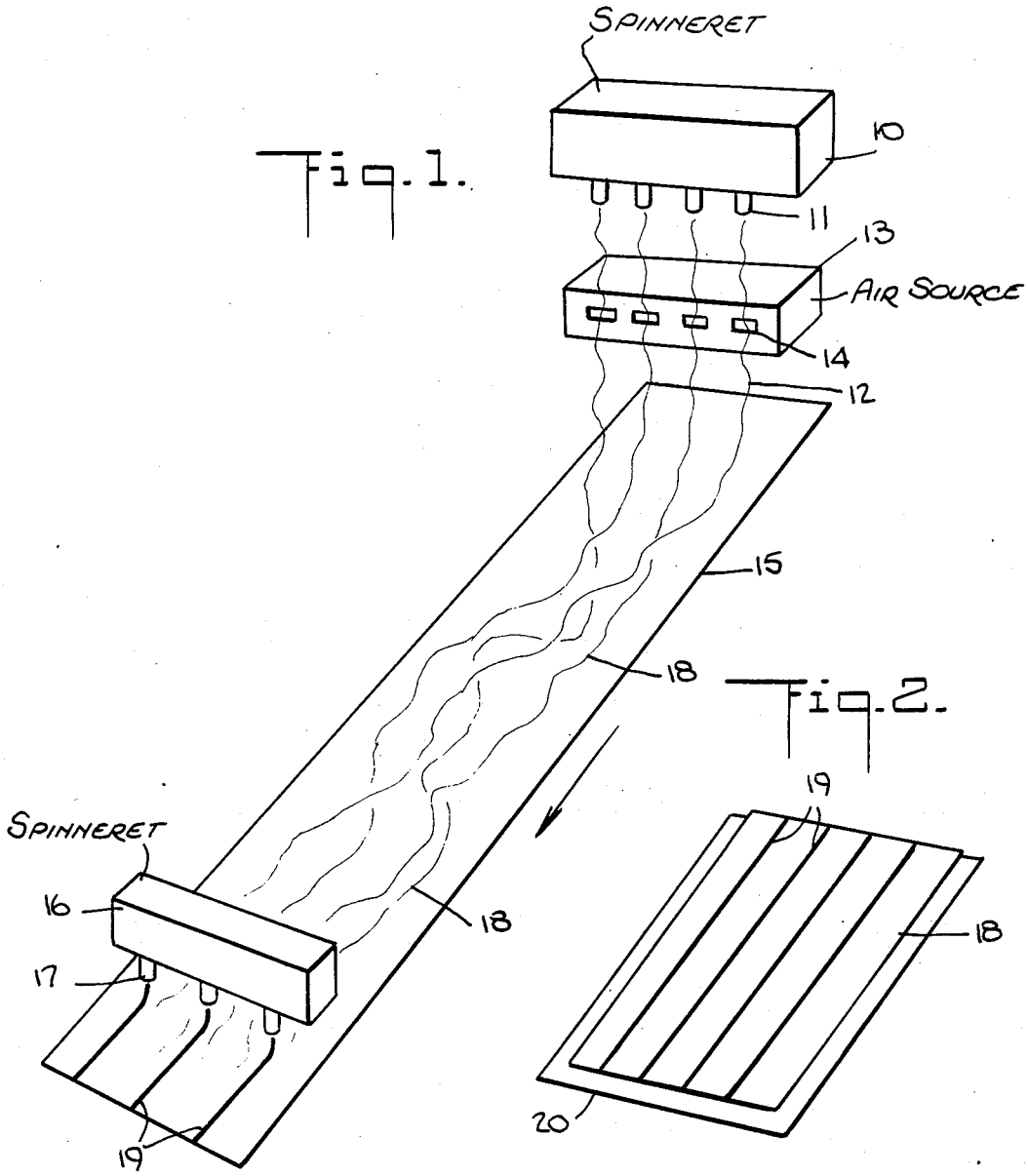
Fig. 1.
Fig. 2.
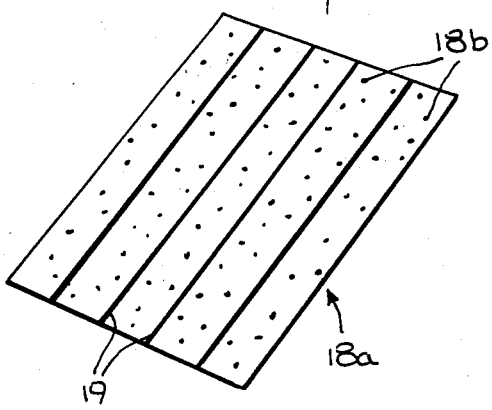
Fig. 3.
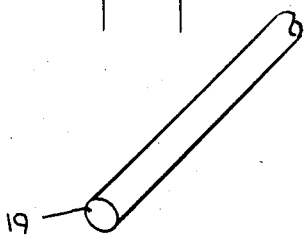
Fig. 4.

TEXTILE INTERLINING MATERIAL HAVING ANISOTROPIC PROPERTIES

The invention relates to a textile interlining material which contains reinforcements acting anisotropically, in at least one preferred direction. These reinforcements comprise reinforcing filaments fixed on a substrate in a defined arrangement. A method is also described, whereby such an interlining material can be made in a simple manner.

Such interlining materials serve as means for stiffening garments between the face material and the lining, it being often desirable for the stiffening action to be greater in one direction than in the other. On the other hand, special ease in folding in one direction can be of advantage to the wearability and appearance of an article of clothing.

It is known to achieve these anisotropic properties in textile interlining materials by the orientation of the fibers, especially when the interlining materials are made of a non-woven material. It is furthermore possible to produce an interlining material having highly directional properties by fixing textile strip material in a specific alignment on a nonwoven fabric.

All of these methods may be practicable in the production of model garments, but they are impractical for mass-produced garments for reasons of cost, on account of their complexity.

A stiffening material has been proposed in German Patent Application No. 19 54 801, whose reinforcements are applied in the form of dots or lines to a textile substrate. The effects on the anisotropy, however, have proven to be quite insignificant in practice.

It is also known to lay oriented filaments between two layers of stiffening material. Aside from the technical difficulties involved in positioning these filaments appropriately, there is always the danger that the filaments may be pulled out of the laminate or may work out due to the movements of the wearer of the garment, so that in time the interlining material loses its (directional) stiffening action.

It is an object of the invention to provide a new and improved interlining material having anisotropic properties, but one which would be technically and economically acceptable with regard to the method whereby it is incorporated into a garment.

It is another object of the invention to provide a new and improved, simple manufacturing method of making this interlining material by mass production.

These objects are achieved by an interlining material defined by the claims, and by the method defined by the claims. It is important that the parallel stiffening filaments be unable to soften after production on account of their high melting point (over 180° C.), while the substrate surface on which these filaments are fixed comprises material that is easily fusible (fusible under 150° C.). In addition to the firm adhesion of the reinforcements on the interlining material, these parameters also result in advantages when they are incorporated into the garments, as will be explained hereinbelow.

SUMMARY OF THE INVENTION

In accordance with the invention, a textile interlining material having anisotropic properties comprises a substrate having a surface that melts below 150° C. and a layer of substantially parallel reinforcing filaments that have a melting point above 180° C. and that are thermally bonded to the aforesaid surface.

Also in accordance with the invention, a method of making a textile interlining material with anisotropic properties comprises applying by extrusion and thermally affixing reinforcing filaments running parallel to one another and melting above 180° C. to a substrate surface melting at a temperature below 150° C.

For a better understanding of the present invention, together with other and further objects thereof, reference is made to the following description, taken in connection with the accompanying drawings, and its scope will be pointed out in the appended claims.

Referring now to the drawings:

FIG. 1 is a diagrammatic perspective view of apparatus operating in accordance with a method, in accordance with the invention, of making a textile interlining material with anisotropic properties;

FIG. 2 is a diagrammatic perspective, fragmentary view of a textile interlining material having anisotropic properties on a release-coated carrier;

FIG. 3 is a diagrammatic perspective, fragmentary view of a textile interlining material constructed in accordance with another form of the invention; and FIG. 4 is a fragmentary perspective view, to an enlarged scale, of a reinforcing filament of the FIG. 2 material.

DESCRIPTION OF THE PREFERRED EMBODIMENTS

Referring now more particularly to FIG. 1 of the drawings, a method of making a textile interlining material having anisotropic properties comprises applying by extrusion and thermally affixing reinforcing filaments running parallel to one another and melting above 180° C. to a substrate melting at a temperature below 150° C. The FIG. 1 apparatus represents a first transversely arranged linear spinneret 10 having orifices 11 which may be, for example, 15 cm above a non-fusible substrate, for example, a release-coated paper carrier 15 or a web of randomly arranged polyester and viscous fibers followed by needling and impregnation with acrylate binder. The web is passed continuously at, for example, 10 meters per minute beneath the spinneret 10. Filaments of, for example, a terpolymer of nylon 6, 66 and 12 are extruded from the orifices 11. An air source 13 having slots 14 positioned close to and parallel to the row of orifices stretch the filaments as they pass down towards the carrier 15. The filaments are still partially fused upon impact with the carrier 15. The filaments 12 form a surface 18 that melts below 150° C.

A second spinneret 16 having a row of orifices 17 beneath which the substrate comprising the fusible surface 18 passes is positioned above the fusible surface. Each orifice has a circular diameter of, for example, 0.5 mm. The spinneret 16 extrudes substantially parallel reinforcing filaments that have a melting point above 180° C. and that are thermally bonded to the fusible surface. The orifices 17 are, for example, from 0.5 to 3 cm, and preferably about 1 cm, above the carrier. The carrier preferably is drawn away from the orifices at a speed faster than the speed of the filaments as they approach the carrier with the result that the filaments are slightly stretched to a degree of about 3 times to a diameter of about 0.2 mm upon contact with the carrier and they maintain their parallel configuration. If desired, the filaments may additionally be stretched by gas streams emerging close to the extrusion orifices, but these gas streams should not be such as to create so much turbulence adjacent to the carrier that the parallel configuration of the filaments is destroyed.

Referring now to FIG. 2, there is represented, in fragmentary view, a textile interlining material constructed in accordance with the invention and having anisotropic properties. The material comprises a substrate comprising a surface 18 that melts below 180° C. and a layer of substantially parallel reinforcing filaments 19 that are thermally bonded to the surface 18. A nonfusible substrate 20 is under the surface 18 which is fusible and may be thermally bonded thereto. The nonfusible substrate may, for example, comprise an interlining material. Alternatively, the surface 18 may be supported by a release-coated carrier, for example, silicone-coated paper. The surface 18 is formed from randomly disposed fusible filaments fused to each other.

Referring now to FIG. 3, the fusible surface 18*a* is formed from fusible powder particles 18*b* fused to each other. The surface 18 of FIG. 2 or the surface 18*a* of FIG. 3 comprises low-melting polymeric material. The polymeric material preferably is selected from the group consisting of polyolefines, polyurethanes, polyesters and polyamides. The polymeric material preferably is a terpolymer of nylon 6, 66 and 12. The reinforcing filaments 19 preferably are of a polyamide polymer which has a melting temperature of 290° C. The reinforcing filaments preferably have a diameter in the range of 0.1 to 0.4 mm, and preferably around 0.2 to 0.3 mm. They may be provided as groups of filaments fused in contact with one another, but preferably they are provided as individual monofilaments and preferably they have a substantially circular cross-section as represented in FIG. 4. The filaments 19 are generally positioned in a rectilinear arrangement. It is generally desired that the spacing between filaments should be substantially uniform and constant but some variations may occur during manufacture and are tolerable.

The substrate can consist entirely of material which melts below 150° C., such as, for example, a nonwoven material of thermoplastic fibers as described in German Patent Application No. 15 60 777. During the hot pressing of the interlining material onto the infusible face material, or during another step in the manufacture of the garment, this substrate can be destroyed by providing such that only the direction-determining, thermally less sensitive reinforcing filaments remain while the residues of the substrate serve as the hot-melt adhesive material only area-wise bonded to the high-melting reinforcing filament layer.

In general, however, the substrate has a defined surface melting below 150° C., preferably lying on an infusible or high-melting (over 180° C.) ground layer.

The easily fusible surface can consist of hot-melt adhesive powder uniformly distributed or imprinted in a pattern of dots or lines. Advantageously, however, it consists of hot-melt adhesive fibers or filaments which are bonded onto an infusible ground material, preference being given to an irregular arrangement. The filaments preferably are also to be bonded to one another by virtue of becoming tacky when hot. A method of producing such fiber layers is described in German Patent Application No. 15 60 777.

The filaments forming this easily fusible surface have, for example, a diameter of $5\times10^{-3}$ to $5\times10^{-2}$ mm, preferably 0.01 to 0.02 mm. They preferably have a melting point of 80° to 120° C. Any common, low-melting polymeric fiber material is suitable, examples being polyolefins, polyurethanes, polyesters and polyamides, including copolymers, terpolymers and higher polymers of polyamides such as a terpolymer of nylon 6, nylon 66 and nylon 12, which would be especially advantageous.

The parallel-aligned, high-melting reinforcing filaments are, for example, to have diameters from 0.1 to 0.4 mm, preference being given to diameters between 0.2 and 0.3 mm. They can be applied to the easily fusible substrate surface in the form of, for example, clusters of filaments bonded by fusion to one another, but preferably in the form of independent monofilaments. In cross section, they should ideally have a circular configuration. The distance between the monofilaments can be, in accordance with the invention, for example, from 0.5 to 5 mm, preferably 1 to 3 mm, and care should be taken to see that they preferably are evenly spaced apart. The rows of filaments can cross one another at right angles.

The softening point of the reinforcing filaments must be above 180° C., so that they will not lose their filamentous character during the manufacture of garments, especially during pressing and ironing-on. Melting points of 200° to 300° C. are therefore advantageous. The materials can be any high-melting, fiber-forming polymers, such as the various types of polyester, polyamide, polyolefin, polyurethane and polyvinyl chloride.

If the substrate, as mentioned above, consists uniformly of easily fusible material, it preferably is to have a specific weight of 10 to 80 g/m$^2$ or, better, 20 to 50 g/m$^2$.

If the substrate consists of an infusible support material and an easily fusible surface, a specific weight of 5 to 50 g/m$^2$, preferably 10 to 20 g/m$^2$, is advantageous.

The specific weight of the reinforcing filaments is to amount, in accordance with the invention, for example, to 10 to 100 g/m$^2$, preferably 20 to 50 g/m$^2$, it being a rule of thumb for it to be 0.5 to 4 times, but advantageously 2 to 3 times, as great as the weight of the easily fusible substrate surface.

A homogeneous, easily melting substrate can be produced on any easily removable support, for example, release-coated paper such as silicone-coated paper. In the case of two-layer substrates, the high-melting support consists preferably of ordinary, known interlining material such as woven fabrics, jerseys, nonwovens, and crosslinked or noncrosslinked foams. If a nonwoven is selected, preference is to be given to bonded random nonwovens.

The high-melting reinforcing filaments are bonded thermally to the substrate surface, as previously mentioned. This can be performed on the basis of the heat which they still contain after leaving the spinerets and which is imparted to the substrate surface, melting it at the points of contact with the fibers. Or else the filaments can be placed on the substrate in cooler condition, and in this case a reheating of the laminate is required to make the surface tacky.

It is furthermore possible to lay the filaments parallel to one another on an intermediate support and to apply the fusible substrate surface to this lay-up and bond it thereto. The resulting laminate of reinforcing filaments and support and the fusible sheet material can then be duplexed to a substrate by hot pressing the exposed side of the fusible surface against it and then withdrawing the support.

Preferably, the easily fusible surface of the substrate is produced by extrusion from spinnerets arranged in rows; the filaments preferably are stretched while still in the fused state by gas streams acting directly on the spinneret holes, and they are deposited randomly on a nonadhering or infusible intermediate support. The intermediate carrier is in this case situated about 8 to 25 cm below the row of spinnerets. This spacing preferably is to be selected such that the fibers are laid down singly.

The reinforcing filaments can then be deposited on the easily fusible surface in a parallel arrangement. They are extruded from a second row of nozzles disposed in rows. This second row of nozzles is to be at a distance of, for example, 0.5 to 3 cm, but preferably of about 1 cm, away from the substrate surface.

For the purpose of giving a slight draft to the reinforcing filaments, the substrate preferably is made to pass below the row of nozzles at a faster rate than the fiber production rate. Fiber drawing by gas streams is also possible; the gas velocity, however, should not result in turbulence, so that the filaments will remain substantially parallel.

It may be desirable for the strength characteristics of the interlining material to vary over its length. For example, it is possible in the case of breastpieces for the specific weight of the parallel, high-melting reinforcing element be graded by varying the diameter of the spinnerets, or by continually varying their distance from one another during the extrusion process.

The titer of the easily fusible filaments can be varied from area to area of the substrate during spinning.

EXAMPLE

A bonded, infusible interlining material is formed from a random mat containing polyester and viscose fibers; the consolidation is performed by needling and impregnation with an acrylate binding agent. This mat, to be regarded as the substrate, passes at the rate of 10 meters per minute under two transversely disposed, linear rows of spinnerets. The first of these rows is situated 15 cm above the fiber surface and emits terpolymer filaments of nylon 6, nylon 66 and nylon 12. Air streams aimed parallel to the fibers and produced from orifices situated directly at the spinnerets stretch these filaments before they contact the surface on which they are deposited.

When they strike the substrate, the filaments are thermally bonded on the basis of the extrusion heat they still contain. The extrusion rate is so adjusted that the specific weight of the substrate surface thus formed amounts to 15 g/m$^2$ at a filament diameter of 0.01 mm.

The second row of spinnerets under which the substrate laminate thus formed passes at a distance of 1 cm comprises orifices having a circular diameter of 0.5 mm. With these spinnerets a polyamide polymer with a melting point of 290° C. is extruded to form reinforcing filaments, while the substrate surface is adjusted to a velocity at which the filaments are drawn to about three times their initial length and have a diameter of 0.2 mm at the moment of deposition. The resulting reinforcing layer of parallel filaments has a specific weight of 35 g/m$^2$. The residual heat of the reinforcing filaments amounts still to about 150° C. under these manufacturing conditions, when they strike the substrate surface, and this is sufficient to soften them so that the filaments are immediately fixed as they strike the substrate.

The product can be an iron-on or sew-on interlining material. When it is bent transversely of the parallel reinforcing filaments, it produces a pronounced rounding effect and is thus outstandingly suitable for cuffs and collars.

Excellent shape-keeping and resiliency is achieved if a trouser waist-band or coat-waist-band is cut transversely of the direction of the filaments, while on the other hand a great strengthening effect is produced by cutting parallel to the direction of the filaments.

Furthermore, the interlining material of the invention can be inserted into breast pieces, in which case the parallel filaments preferably run transversely. A high strengthening effect is thus achieved transversely of the breast pieces, combined with the ability to fold easily in the direction in perpendicular thereto.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A textile interlining material having anisotropic properties comprising:

a substrate comprising a surface that melts below 150° C. and a layer of substantially parallel reinforcing filaments that have a melting point above 180° C. and that are thermally bonded to said surface, the substrate comprising infusible material whose surface is provided with a hot-melt adhesive pattern in the form of dots, rows of dots, lines, or surfaces, in a regular or random arrangement.

2. A textile interlining material in accordance with claim 1 in which said substrate comprises a non-fusible substrate under said surface which is fusible and is thermally bonded thereto.

3. A textile interlining material in accordance with claim 2 in which said non-fusible substrate comprises an interlining material.

4. A textile interlining material in accordance with claim 1, in which the substrate comprises a homogeneous thermoplastic fiber composite whose melting temperature is below 150° C. and whose specific weight amounts to 10 to 80 g/m$^2$.

5. A textile interlining material in accordance with claim 4, in which the homogeneous substrate can be destroyed by heat to such an extent that thereafter substrate material remains only area-wise bonded to the high-melting reinforcing filament layer.

6. A textile interlining material in accordance with claim 1, in which the substrate comprises infusible material whose surface is formed by a random mat of interconnected thermoplastic filaments whose melting temperature is below 150° C.

7. A textile interlining material in accordance with claim 6, in which the thermoplastic filaments have diameters between $5\times10^{-3}$ and $5\times10^{-2}$ mm and the specific weight of the filament layer is 5 to 50 g/m$^2$.

8. A textile interlining material in accordance with claim 6, in which the thermoplastic filaments have diameters of 0.01 to 0.02 mm and the surface layer weighs 10 to 20 g/m$^2$.

9. A textile interlining material in accordance with claim 6, in which the melting temperature of the thermoplastic filaments is between 80° and 120° C.

10. A textile interlining material in accordance with claim 1, in which the substrate infusible material is nonwoven material.

11. A textile interlining material in accordance with claim 2, in which the specific weight of the reinforcing filament layer amounts to twice to three times the fusible surface of the substrate material.

12. A textile interlining material in accordance with claim 1, in which the reinforcing layer has a specific weight of 10 to 100 g/m$^2$.

13. A textile interlining material in accordance with claim 1, in which the reinforcing filament cross sections have a substantially circular configuration.

14. A textile interlining material in accordance with claim 13, in which the reinforcing filaments have a diameter of 0.1 to 0.4 mm.

15. A textile interlining material in accordance with claim 1, in which the distances of the reinforcing filaments from one another amount to 0.5 to 5 mm.

16. A textile interlining material in accordance with claim 1, in which the parallel reinforcing filaments bonded to the substrate surface and melting above 180° C. comprise filament clusters cemented to one another.

17. A textile interlining material in accordance with claim 1, in which the parallel reinforcing filaments melting above 180° C. and bonded to the substrate surface are individual monofilaments.

18. A textile interlining material in accordance with claim 1, in which the reinforcing filaments are disposed parallel at a distance of 2 mm from one another on the substrate surface.

19. A textile interlining material in accordance with claim 1, in which parallel bands of the reinforcing filaments cross one another at right angles.

20. A textile interlining material in accordance with claim 1, in which the parallel spacing of the reinforcing filaments from one another varies from one area to another.

21. A textile interlining material in accordance with claim 1, in which the melting point of the reinforcing filaments is between 200° and 300° C.

22. A textile interlining material in accordance with claim 1, in which said substrate is supported by a release-coated carrier.

23. A textile interlining material in accordance with claim 1, in which said fusible surface is formed from randomly disposed fusible filaments fused to each other.

24. A textile interlining material in accordance with claim 1, in which said fusible surface is formed from fusible powder particles fused to each other.

25. A textile interlining material in accordance with claim 1, in which said fusible surface comprises low-melting polymeric material.

26. A textile interlining material in accordance with claim 25, in which said polymeric material is selected from the group consisting of polyolefines, polyurethanes, polysters and polyamides.

27. A textile interlining material in accordance with claim 25, in which said polymeric material is a terpolymer of nylon 6, 66 and 12, 28. An interlining material in accordance with claim 1, in which said reinforcing filaments are of a polyamide polymer.

29. A textile interlining material in accordance with claim 28, in which said polyamide polymer has a melting temperature of 290° C.

30. A textile interlining material in accordance with claim 1, in which said reinforcing filaments have a substantially circular cross-section having a diameter in the range of 0.1 to 0.4 mm and a substantially uniform spacing in the range of 1 to 3 mm.

31. A textile interlining material in accordance with claim 30, in which said diameter is approximately 0.2 to 0.3 mm.

32. A textile interlining material in accordance with claim 31, in which said spacing is approximately 2 mm.

* * * * *